US009441412B1

(12) United States Patent
Hooper, Jr. et al.

(10) Patent No.: US 9,441,412 B1
(45) Date of Patent: Sep. 13, 2016

(54) HIGH THERMAL PERFORMANCE WINDOW FRAME

(71) Applicant: Alcoa Inc., Pittsburgh, PA (US)

(72) Inventors: William J. Hooper, Jr., Lawrenceville, GA (US); Ion-Horatiu Barbulescu, Atlanta, GA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 14/699,111

(22) Filed: Apr. 29, 2015

(51) Int. Cl.

| | |
|---|---|
| ***E06B 3/26*** | (2006.01) |
| ***E06B 3/263*** | (2006.01) |
| ***E06B 3/14*** | (2006.01) |
| ***E06B 3/54*** | (2006.01) |
| ***E06B 3/56*** | (2006.01) |

(52) U.S. Cl.
CPC ..... *E06B 3/263* (2013.01); *E06B 3/14* (2013.01); *E06B 3/26301* (2013.01); *E06B 3/5454* (2013.01); *E06B 3/56* (2013.01); *E06B 2003/26378* (2013.01)

(58) Field of Classification Search
CPC ..... E06B 2003/26349; E06B 2003/26361; E06B 2003/26378; E06B 2003/26372; Y10S 49/01
See application file for complete search history.

(56) References Cited

U.S. PATENT DOCUMENTS

| | | | | |
|---|---|---|---|---|
| 3,093,217 | A * | 6/1963 | Doede | E04B 2/96 49/DIG. 1 |
| 3,204,324 | A * | 9/1965 | Fridthjov | 29/897.312 |
| 3,885,371 | A | 5/1975 | Oakes | |
| 4,275,526 | A | 6/1981 | Abramson | |
| 4,330,919 | A * | 5/1982 | Bischlipp et al. | 29/418 |
| 4,342,144 | A * | 8/1982 | Doguchi | 29/897.312 |
| 4,420,919 | A * | 12/1983 | Weber | 52/204.595 |
| 4,495,726 | A * | 1/1985 | Lindstrom | 49/401 |
| 4,524,112 | A * | 6/1985 | Willert | 428/595 |
| 4,589,240 | A | 5/1986 | Kendall et al. | |
| 4,614,062 | A * | 9/1986 | Sperr | 49/504 |
| 4,875,316 | A * | 10/1989 | Johnston | E06B 3/26336 52/204.593 |
| 5,187,867 | A | 2/1993 | Rawlings | |
| 6,430,889 | B1 | 8/2002 | Nixon et al. | |
| 7,096,640 | B1 * | 8/2006 | Chevian et al. | 52/204.591 |
| 8,322,090 | B2 | 12/2012 | Moriya et al. | |
| 2010/0018139 | A1 | 1/2010 | Brunnhofer | |
| 2014/0053488 | A1 * | 2/2014 | Lenox et al. | 52/404.1 |

FOREIGN PATENT DOCUMENTS

DE 2625533 A1 * 12/1977

OTHER PUBLICATIONS

Machine translation of DE 26 25 533 A1, date pulled Jul. 13, 2015, p. 1-3.*

* cited by examiner

*Primary Examiner* — Elizabeth A Quast
(74) *Attorney, Agent, or Firm* — Greenberg Traurig, LLP

(57) ABSTRACT

A composite construction for windows and doors has one or more components of the frame and/or window unit fabricated as a composite having a structural foam intermediate member onto which exterior and interior aluminum extrusions are mechanically and adhesively attached. The foam member functions as a structural bridge between the extrusions, as a thermal break and may also provide support for an internal seal to prevent air infiltration.

20 Claims, 6 Drawing Sheets

HIGH THERMAL PERFORMANCE WINDOW FRAME

FIELD

The present invention relates to windows and doors, and more particularly, to apparatus and methods for changing the rate of energy transfer through doors, windows and assemblies made from a plurality of parts, such as extrusions of aluminum metal or plastic.

BACKGROUND

Windows, doors, skylights and structural components made from materials such as aluminum, alloys thereof, steel and plastics are known. For example, window and door assemblies may be made from aluminum alloy extrusions. Windows manufactured with aluminum frame and thermal break components are also known. For example, manufacturers use pour-and-debridge and crimped polyamide strips to make aluminum windows with thermal breaks. The pour-and-debridge type window uses liquid polyurethane poured in the pocket of an aluminum extrusion. After the polyurethane solidifies, the aluminum backing of the pocket is cut away. The process involves four different operations: polyurethane mixing, lancing the aluminum extrusion, abrasion conditioning of the aluminum extrusion and cutting the backing of the thermal break. The crimped polyamide method uses polyamide (or other polymer) strips that are crimped at both ends into the internal and external aluminum extrusions of the window frame. In this case, the manufacturing process requires three different operations: knurling the aluminum extrusions, inserting the polyamide and crimping the aluminum extrusions. Windows that use pour-and-debridge thermal breaks may have a general U factor of about 0.5 Btu/h $ft^2$ F and windows that use crimped polyamide may have a general U factor of about 0.3 Btu/h $ft^2$ F. This corresponds to about an R3 thermal resistance. Both of these technologies require a significant number of manufacturing steps and expensive manufacturing equipment. Alternative methods, apparatus and manufactures for modifying energy transfer through windows, doors and other structural components remains desirable.

SUMMARY

The disclosed subject matter relates to a weather barrier device for covering an opening in a structure, the device having at least one glazing panel, a plurality of support members disposed about the periphery of the glazing panel, at least one elongated structural foam member, and first and second rigid elongated members, each having a recess therein capable of accommodating the foam member to form a composite member with the first rigid elongated member on one side of the foam member and the second rigid elongated member on another side of the foam member to form a composite member, the composite member forming at least one of the plurality of support members.

In another embodiment, the recess of each rigid elongated member has a U shaped cross section defined by a pair of legs extending from a back wall, the foam member being received between the pair of legs.

In another embodiment, each of the pair of legs has a barb on an outer edge distal to the back wall, the barb having a lead-in surface facilitating the sliding of the foam member between the pair of legs, the barbs retaining the foam member between the pair of legs, inhibiting removal thereof.

In another embodiment, the device has an adhesive applied between the foam member and the elongated rigid members.

In another embodiment, the device has spacers extending from the back wall to provide a space for adhesive of a selected thickness to reside between the foam member and the first and second rigid elongated members when the foam member is urged into the recesses thereof.

In another embodiment, the device has reliefs within an interior surface of the recess, the reliefs providing space for excess adhesive to accumulate therein when the foam member is urged into the recess.

In another embodiment, the elongated rigid members each have a pair of sidewalls extending from the back wall distal to the legs and a outer wall attached to the pair of sidewalls distal to the back wall.

In another embodiment, the elongated rigid members are aluminum extrusions.

In another embodiment, the device is a window or a door.

In another embodiment, the glazing unit is surrounded by a sash having four sides, each of the four sides of the sash being formed from a composite member, In another embodiment, the sash is surrounded by a frame having four sides, each of the four sides of the frame being formed from a composite member.

In another embodiment, at least one of the foam members making up the sash or the frame has a surface against which a weather seal may abut, the foam member of the other of the frame or the sash supporting the weather seal.

In another embodiment, the weather seal is retained on a plate extending over the foam member and the plate is over-ridden by the tooth of one leg of each of the first and second rigid elongated members.

In another embodiment, the weather seal is retained on the foam member by adhesive.

In another embodiment, the weather seal is a first weather seal and further comprising at least one other weather seal, the first weather seal being a redundant weather seal.

In another embodiment, the at least one other weather seal includes two other weather seals, an inside weather seal and an outside weather seal, the redundant weather seal positioned intermediate the inside and outside seals.

In another embodiment, the weather seal is retained in an aperture in the foam member by a barbed leg extending from the seal which extends into the aperture.

In another embodiment, a window has at least one glazing panel and a plurality of support members disposed about the periphery of the glazing panel. Each of the plurality of support members have an elongated structural foam member interposed between first and second rigid elongated members and each of the first and second rigid elongated members have a U shaped cross section defined by a pair of legs extending from a back wall defining a recess along more than 50% of the length thereof and capable of accommodating the foam member to form a composite member with the first rigid elongated member on one side of the foam member and the second rigid elongated member on another side of the foam member. The foam member is received between the pair of legs, each of the pair of legs having a barb on a outer edge distal to the back wall, the barb having a lead-in surface facilitating the sliding of the foam member between the pair of legs. An adhesive is applied between the foam member and the first and second elongated rigid members, the barbs and adhesive retaining the foam member between the pair of legs, inhibiting removal thereof.

In another embodiment, the elongated rigid members each have a pair of sidewalls extending from the back wall distal to the legs and a outer wall attached to the pair of sidewalls distal to the back wall and wherein the elongated rigid members are aluminum extrusions.

In another embodiment, the window has a rectangular frame having four sides dimensioned to receive the glazing panel surrounded by the plurality of support members, each side of the frame being formed of composite members like the support members and attached at ends thereof to two other of the sides of the frame.

BRIEF DESCRIPTION OF THE DRAWINGS

For a more complete understanding of the present invention, reference is made to the following detailed description of exemplary embodiments considered in conjunction with the accompanying drawings.

DETAILED DESCRIPTION OF EXEMPLARY EMBODIMENTS

The present disclosure reveals a novel thermal break technology that allows manufacture of high performance windows via simplified manufacturing processes. Aspects of the present disclosure include window structures having a composite construction and a simplified manufacturing process for making windows that involves fewer operations and machinery. The outside surfaces of the composite window may be made from aluminum extrusions and a core is made from a high density foam with low thermal conductivity and good structural properties. The foam core may be adhered to the aluminum extrusions by structural adhesive to increase structural integrity.

Figure 1B:
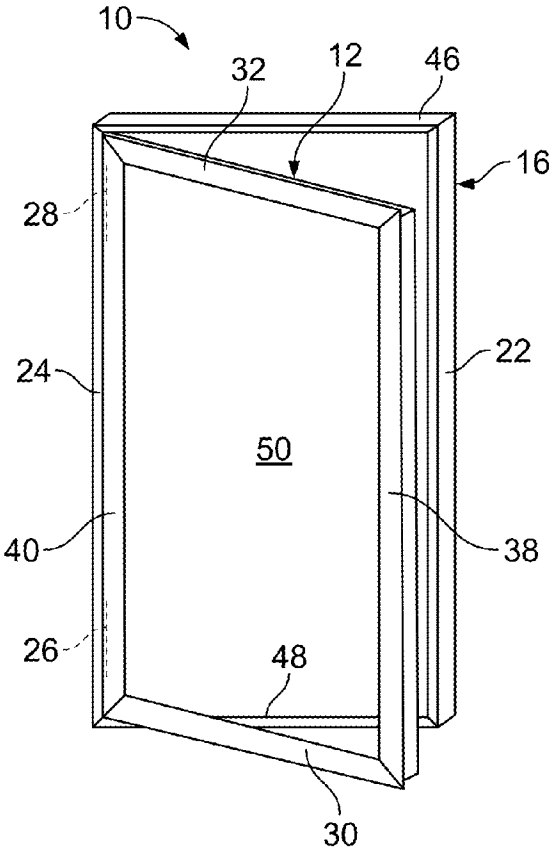
FIGS. 1A and 1B are front views of a casement outswing window assembly in accordance with an embodiment of the present disclosure in the closed and opened states, respectively.
Figure 1A:
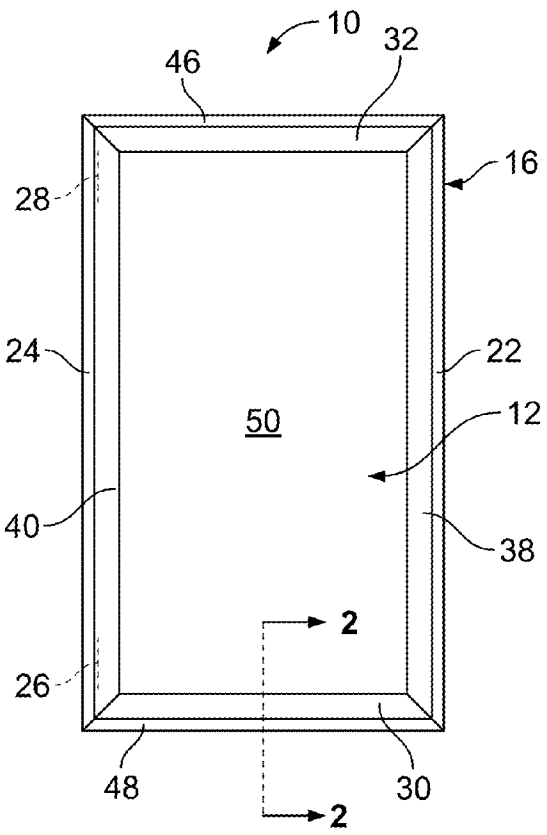

FIGS. 1A and 1B show a casement outswing type window assembly 10 having a sash 12 held within a frame 16 having side jambs 22, 24. The sash 12 pivots on one or more hinges/pivots 26, 28 (diagrammatically shown in dotted lines), allowing the sash 12 to be opened and closed relative to the frame 16. Alternatively, the window assembly 10 may be a hung type window with one or more sashes 12 that are either slideably or hingedly mounted to a frame 16 to allow opening and closing. As yet another alternative, the window assembly 10 may feature one or more non-movable sashes 12. The sash 12 features horizontally oriented rails 30, 32 and vertically oriented stiles 38, 40. The frame 16 has an upper horizontal head 46 and a lower, horizontal sill 48. The glazing 50, e.g., glass or plastic is held within the sash 12. It should be understood that FIG. 1 shows one type of window, but that there are many other types of windows to which the present disclosure may be applied, including moveable and immoveable windows used in residential and commercial applications.

Figure 2:
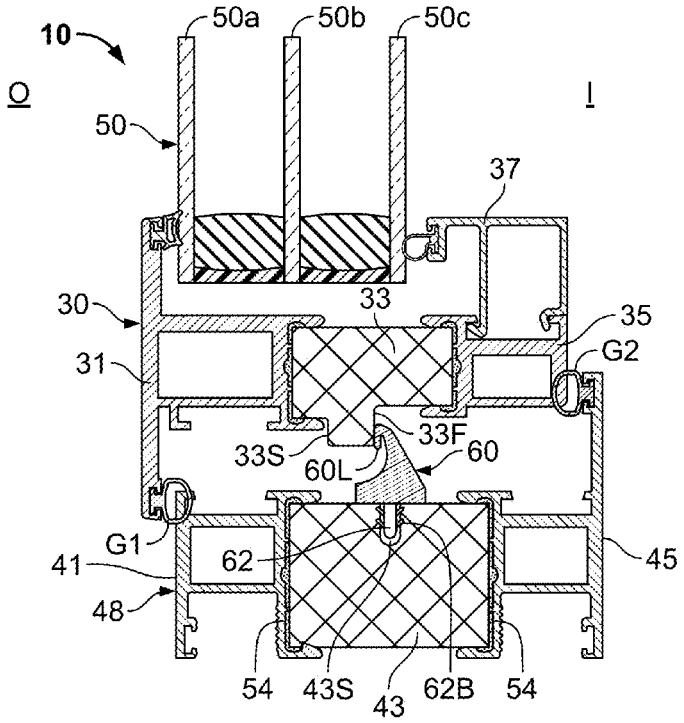
FIG. 2 is a cross-sectional view of the window assembly of FIG. 1, taken along section line 2-2 and looking in the direction of the arrows.
Figure 3:
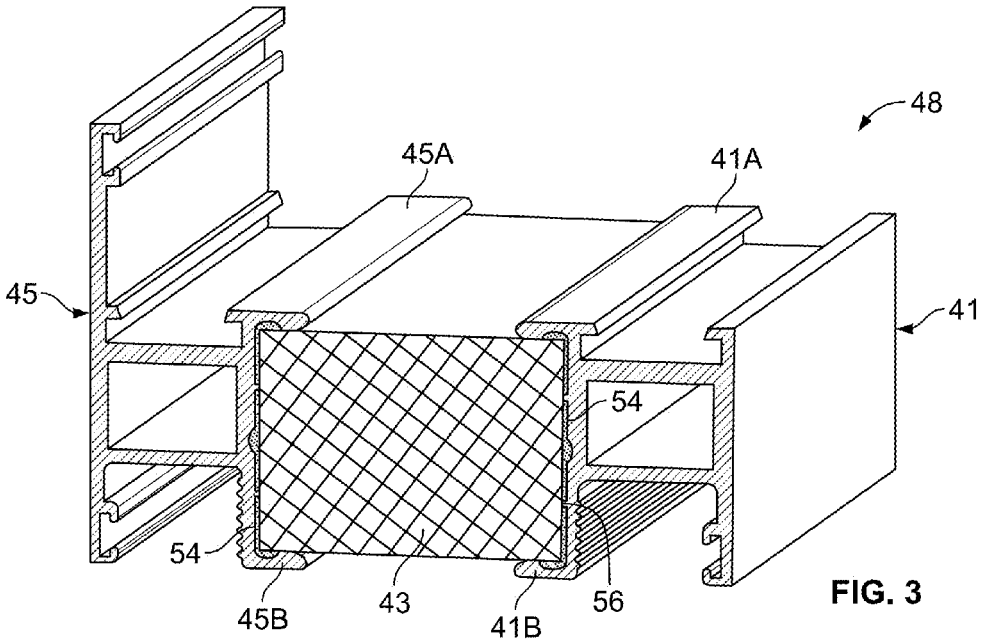
FIG. 3 is a perspective view of a portion of the window assembly of FIGS. 1 and 2.
Figure 5:
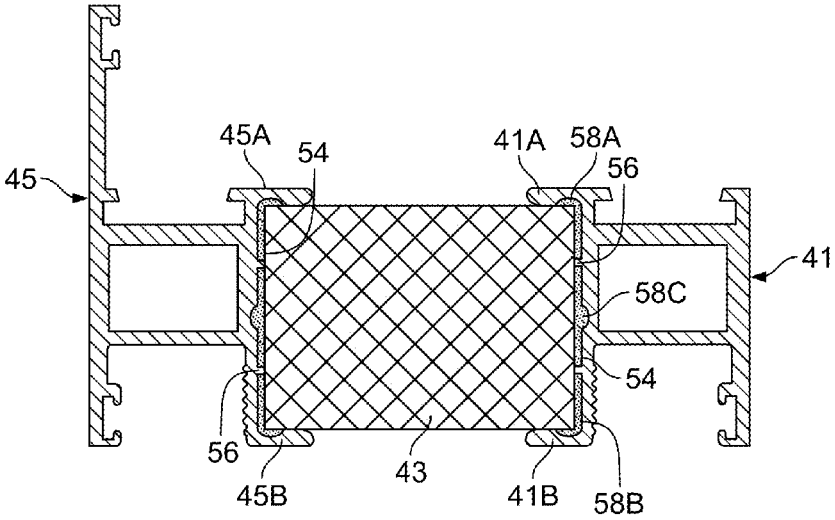
FIG. 5 is an enlarged cross-sectional view of the portion of FIGS. 3 and 4.
Figure 6:
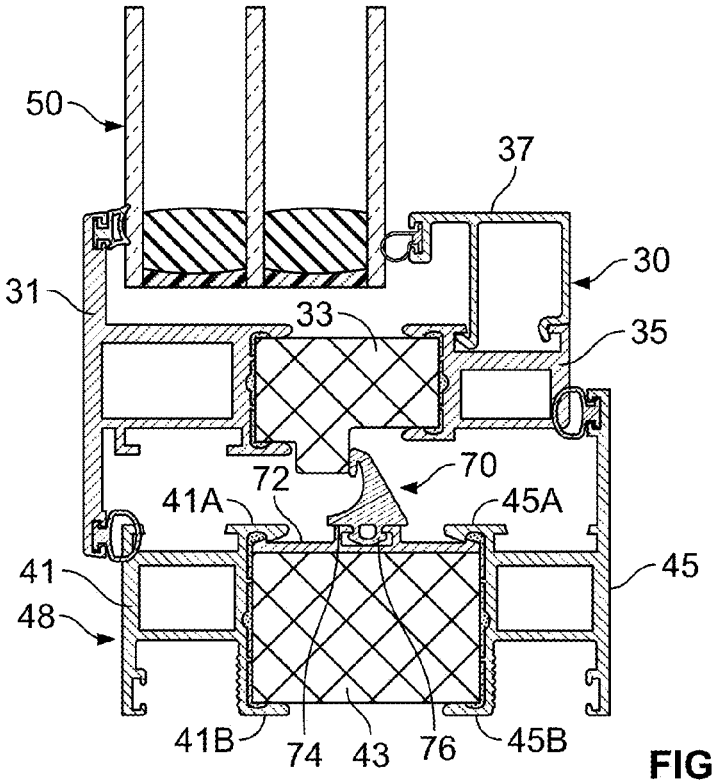
FIG. 6 is a cross-sectional view like FIG. 2 of an alternative embodiment of the present disclosure.
Figure 7:
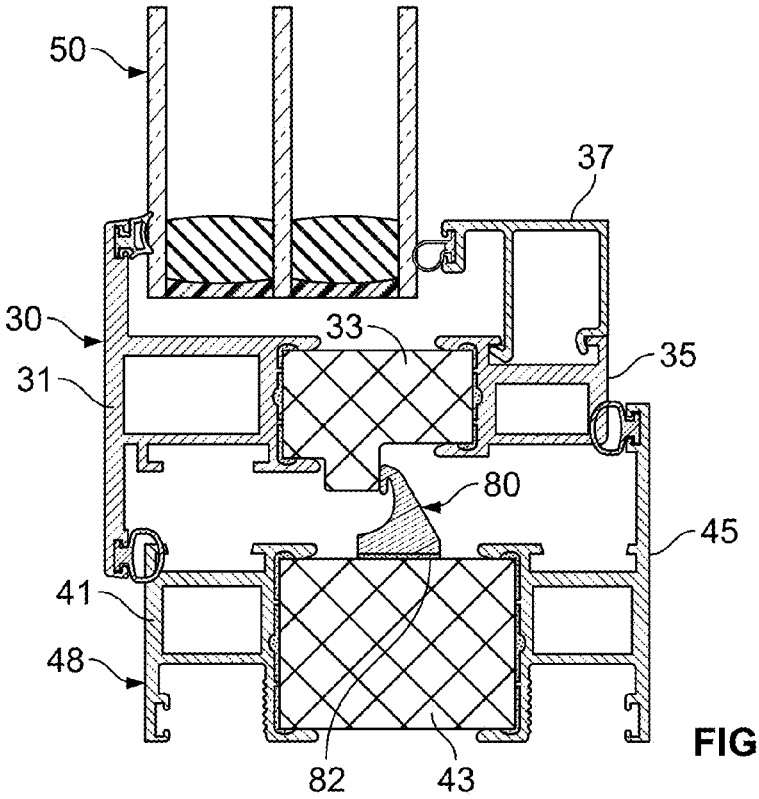
FIG. 7 is a cross-sectional view like FIG. 2 of an alternative embodiment of the present disclosure.

FIGS. 2, 6 and 7 show that the rail 30 may be formed from a plurality of sub-parts 31, 33, 35, 37. The sub-parts 31, 35 and 37 are in the form of extrusions, e.g., of aluminum. The sub-part 33 is a structural foam member, e.g., made from high density polymeric foam, e.g., PVC, polyurethane, etc. having structural properties (tensile strength, shear strength, etc.) suitable for this application. The sub-parts 31 and 35 are mechanically and adhesively coupled to the foam member 33 to form the rail 30. The stiles 38, 40 and rail 32 may be similarly constructed to surround and support the glazing unit 50, which is, in this instance, a triple glazed unit having three spaced glass panes 50*a*, 50*b*, 50*c*. The window frame 16 may have a similar composite construction. For example, the cross-sectional view of the sill 48 shown in FIGS. 2-7 shows a composite construction made from sub-parts 41, 43 and 45, with sub-parts 41 and 45 being extrusions, e.g., of aluminum alloy and sub-part 43 being a structural foam member interposed there between. The foam sub-parts 33 and 43 have a low thermal conductivity of, e.g., about 0.006 W/mK to 0.043 W/mK and function as a structural component as well as a thermal break between the aluminum extrusions 31, 35 and 41, 45, respectively.

Figure 4:
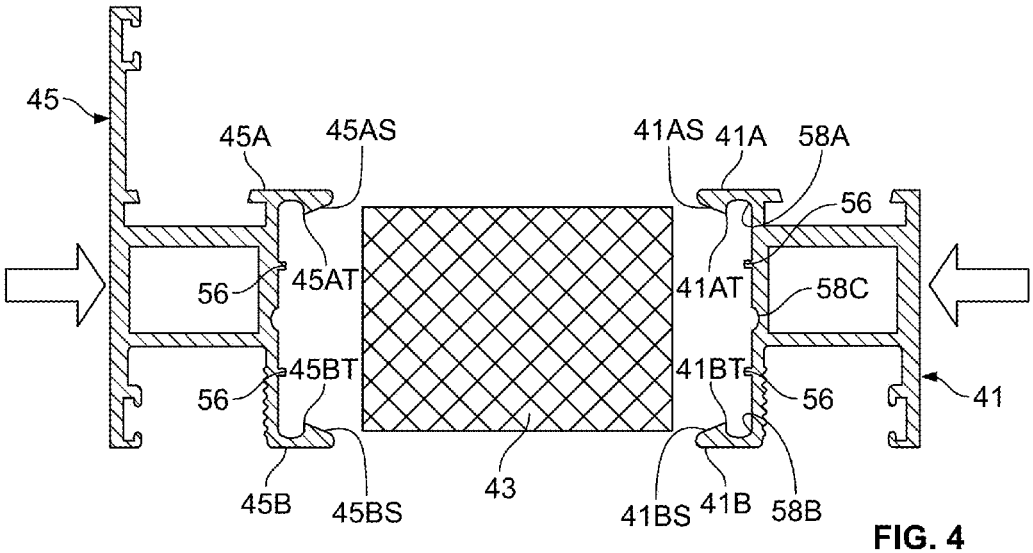
FIG. 4 is an exploded a cross-sectional view of the portion of FIG. 3.

As shown in FIGS. 4 and 5, the extrusion 41 has an upper leg 41A and a lower leg 41B, each having a locking tooth 41AT and 41BT with angled lead-in surfaces 41AS and 41BS, respectively, that facilitate the locking teeth 41AT and 41BT to override the foam sub-part 43 when the foam sub-part is pushed between the upper leg 41A and the lower leg 41B. The teeth 41AT, 41BT and lead-in surfaces 41AS, 41BS induce the foam sub-part 43 to align with the extrusion 41 on center and grip into the foam sub-part 43 preventing disassociation of the extrusion 41 from the foam sub-part 43. This inter-relationship could be described as a slide-and-lock relationship. An adhesive 54 (see FIG. 3) may be applied to either the extrusion 41 and/or to the foam sub-part 43 prior to placing the foam sub-part 43 into position between the legs 41A, 41B. Spacers 56 may be provided to prevent the foam sub-part 43 from being pressed too closely to the extrusion 41 such that the adhesive 54 is displaced from between the extrusion 41 and the foam sub-part 43, leaving too thin a layer of adhesive 56 to provide a bond of sufficient strength. Recesses 58A (upper corner chamber), 58B (lower corner chamber), 58C (center chamber) may also be provided to receive excess adhesive, allowing the spacers 56 to be pressed home against the foam sub-part 43, promoting an optimal adhesive thickness and consistent final assembly dimensions notwithstanding variations in applied volume of adhesive 54.

Once in place between legs 41A, 41B, the foam sub-part 43 is held securely to the extrusion 41, preventing relative sliding motion and allowing any adhesive 54 to cure without relative movement to further form an integrated structure with consistent dimensions. The extrusion 45 has similar upper and lower legs 45A, 45B with teeth 45AT and 45BT and lead-in surfaces 45AS, 45BS that operate in the same way as the corresponding elements of sub-part 41 to secure extrusion 45 to the foam sub-part 43 opposite to extrusion 41. In a similar way, the sub-parts 31 and 35 of the rail 30 (see FIG. 2) may be fastened to the foam sub-part 33, i.e., via a slide and lock arrangement and/or the application of adhesive 54 there between to form a composite or sandwich construction. The adhesive 54 may also perform a sealing function relative to the foam sub-parts 33, 43, in that it fills the open cells of the foam material preventing the entry and retention of moisture.

FIG. 2 shows a gasket 60 with a push-in, barbed leg 62 received in slot 43S in foam sub-part 43. The barbed leg 62 facilitates insertion of the leg 62 into the slot 43S, but resists withdrawal due to the orientation of the barbs 62B. A contact lip 60L of the gasket 60 abuts against face 33F formed on a downwardly extending shoulder 33S of foam sub-part 33 to create a seal against air infiltration when the window assembly 10 is closed. It should be noted that the gasket 60 provides a redundant/additional seal over and above the seals provided by gaskets G1, G2 proximate the outside environment O and the inside environment I, respectively. In this embodiment, the foam sub-parts 33 and 43 participate in the sealing function of the window assembly 10 in addition to the structural and thermal break functions that they perform. The foam sub-part 33 is easily adapted to this function in that the shoulder 33S can be formed by machining/removing material from the foam sub-part 33. Alternatively, the shoulder 33S can be formed during formation of the foam sub-part, e.g., by injection molding. In a similar manner, the structural foam composition of foam sub-part 43 lends itself to easy formation of slot 43S by machining the slot 43S or by injection molding that feature into the foam sub-part 43. The foam sub-parts 33, 43 may alternatively be cut from a larger block of foam, e.g., using a knife, saw, laser, torch, water or air jet.

FIG. 6 shows an alternative form of gasket 70 that is attached to a support plate 72 via a track 74 into which an extension 76 of the gasket 70 is resiliently received. The support plate, which may be made as an extrusion, e.g., from a polymer such as polyamide or ABS, is positioned between the upper legs 41A, 45A and the foam sub-part 43, interlocking with the teeth of the upper legs 41A, 45A.

FIG. 7 shows another alternative gasket 80 that is adhered to foam sub-part 43 via an adhesive 82.

Figure 8:
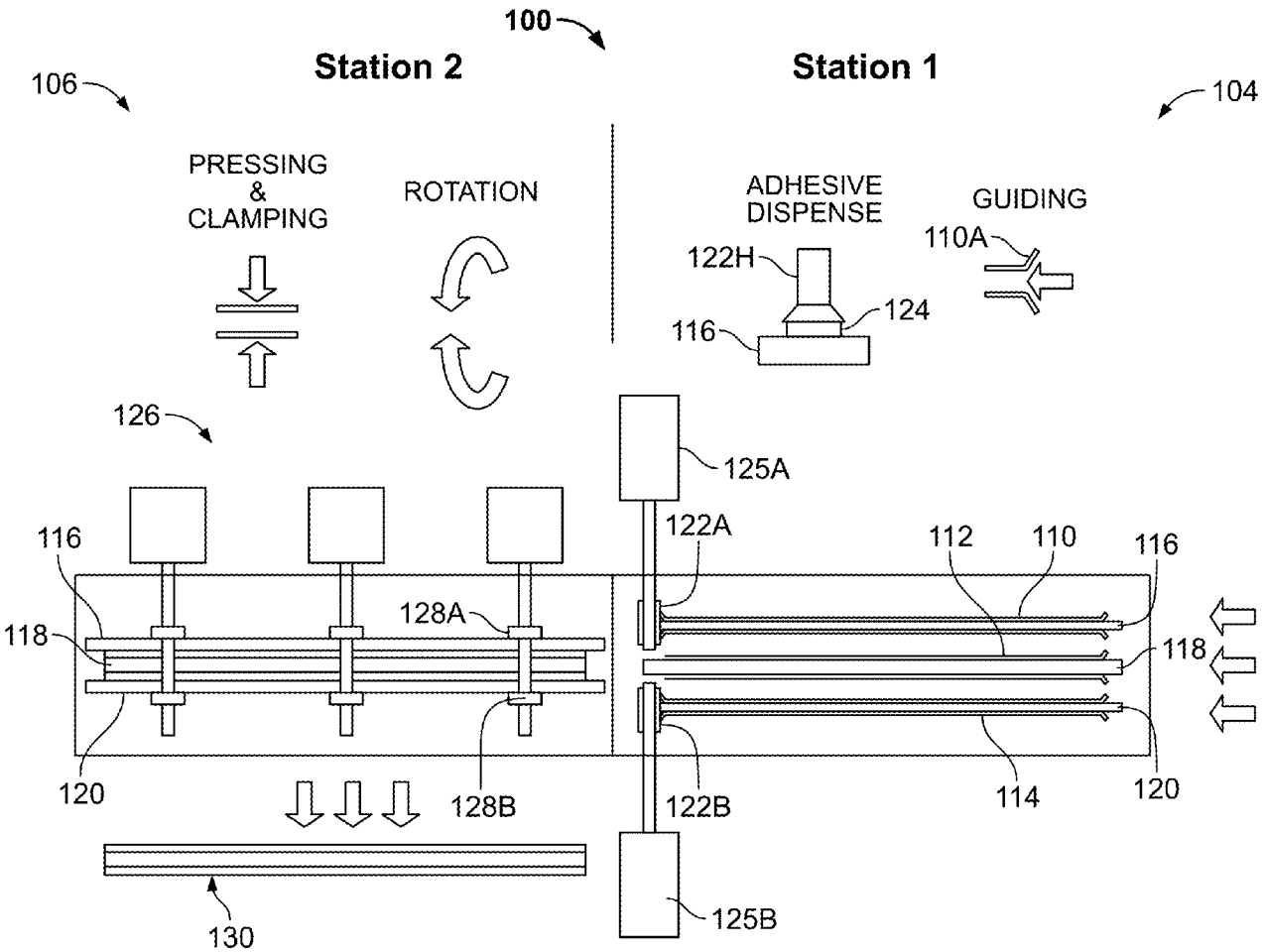
FIG. 8 is a diagrammatic view of method and apparatus for forming a composite member like the portion shown in FIG. 3.

FIG. 8 shows a diagram for a manufacturing process and apparatus for forming composite window components, such as rails 30, 32 and stiles 38, 40, as well as jambs 22, 24, head 46 and sill 48. More particularly, an assembly system 100 may include a first station 104 with a plurality of guides 110, 112, 114 into which aluminum extrusions 116, 120 and intermediate structural foam sub-parts 118 are positioned and advanced toward one or more adhesive dispensers 122A, 122B. The guides 110, 112, 114 may be provided with flared open ends, e.g., 110A, that aid in receiving the respective aluminum extrusion, e.g., 116 or foam sub-part 118 for passage through the guide, e.g., 110. The adhesive dispensers 122A, 122B have a dispenser head 122H that is proportioned to apply adhesive 124 to an extrusion, e.g., 116, 120 or a foam sub-part 118 that passes proximate to it when passing through the guides 110, 112, 114 of the first station 104. Pneumatic drives 125A, 125B may be used for the industrial automation of the adhesive dispensers.

After adhesive is applied to the sub-parts 116, 118, 120, they are advanced to a second station 106 wherein the parallel sub-parts 116, 118, 120 are rotated and then pressed together by a clamping mechanism 126, having one or more sets of grippers 128A, 128B that squeeze the subparts 116, 118, 120 together into an interlocked assembly 130, as explained with respect to FIGS. 1-7. After each assembly 130 is compressed together, it may be offloaded from the second station 106 allowing any adhesive that has been applied to cure entirely, locking the joined sub-parts 116, 118, 120 together. It should be appreciated that the elongated assemblies 130, may be used as composite members 22, 24, 30, 32, 38, 40, 46, 48 and may be attached to one another proximate their respective ends by the use of fasteners, welding, or brackets to form sub-assemblies, such as sash 12 and/or frame 16.

Figure 9:
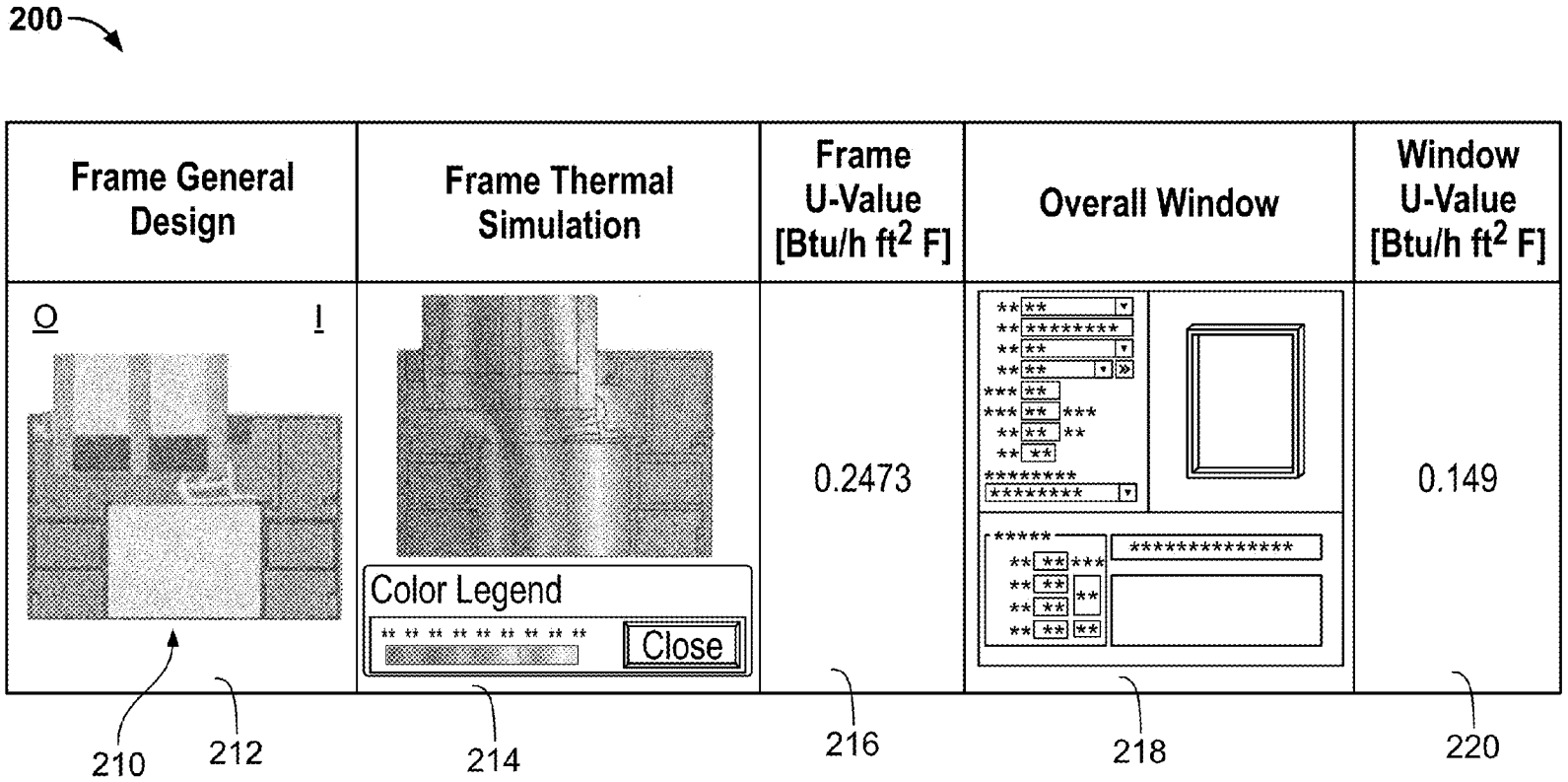
FIG. 9 is an image from a computerized thermal analysis of a fixed window assembly in accordance with an alternative embodiment of the present disclosure.

FIG. 9 shows the graphic output 200 of a computer simulation using U.S. Department of Energy Therm and Window software of the thermal performance of a fixed window unit 210 using the structural foam thermal break composite construction described above. In display portion 212, the cross-sectional structure (frame general design) of a lower portion of a window assembly 210, similar to the portion of window assembly 10 shown in FIG. 2 and dividing outside environment O from inside environment I is illustrated. For the purposes of the computer simulation, the outside environment O is taken to be 18.0 degrees C. and the inside environment I is taken as 21.0 degrees C. In display portion 214, a computer simulation of thermal transfer occurring through lower portion 210 of window assembly 10 is expressed as a temperature gradient represented by grey scale, with cooler temperatures being depicted darker than high temperatures. In the alternative, the computer model may express the temperature gradient in a plurality of colors, with each color's significance related to a given color scale or key. Display portion 216 displays the calculated, numerical U-value, i.e., a 0.2473 U-value for the frame of window system 210 shown in display portion 212. Display portion 218 displays general information concerning the window system 210 under test simulation, namely, the model number, dimensions, type: (double hung, single hung, fixed, etc.) and the simulation results. The calculated U-value for the fixed window is shown in display portion 220 to be 0.149.

As can be appreciated from the above description, the methods and products of the present disclosure are significantly different from the pour-and-de-bridge method and products. More particularly, the structural foam sub-parts 33, 43 are pre-existing solid elements prior to assembly with the extruded parts 31, 35 and 41, 45, respectively. One of the consequences of this is that the structural foam sub-parts 33, 43 may be formed to selected dimensions without the need to: 1. Inject a liquid compound into a three-sided trough/recess in an extruded element; 2. Cut away one side of the trough, which requires a cutting tool set-up which constantly wears, uses a substantial amount of energy and generates debris and metal waste. With respect to the metal waste, the larger the width of the side of the trough that is cut away, the greater the waste of metal. Since the amount of metal waste is increased by the width of the side that is cut away, the greater the dimensions of the space of the trough filled by polymer (to achieve greater insulation), the greater the expense attributable to metal that is wasted. In addition to the side of the trough that is cut away, the overall dimensions of the thermal break in the pour-and-de-bridge formed product and method is defined by the dimensions of the trough into which the liquid polymer is injected. That is, the size of the thermal break is determined by the trough dimensions formed by the extrusion. To achieve a thermal break with greater dimensions (to achieve higher insulative value) the larger the dimensions of the trough that are required. Since the trough is formed from expensive extruded material, e.g., aluminum alloy, this represents higher cost for achieving greater insulative properties. In addition to the high costs attributable to the extrusion forming the "mold" in the pour-and-de-bridge method, it also requires a polymer material that can be applied in liquid form to fill the "mold" and which subsequently hardens/cures. The material must meet the mechanical strength requirements as well as the adhesive engagement requirements that allow the material to adhere to and mechanically integrate adjacent extrusions when cured. At the same time, the material must meet the requirements of application and use with the extrusion in a manner which is environmentally acceptable. All these requirements constitute limitations on the type of materials that can be used for the thermal break in the pour-and-de-bridge method and resultant product.

In contrast, the methods and products of the present disclosure do not have these limitations. For example, since the extruded sub-parts 31, 35 and 41, 45 are not utilized as troughs to form the foam sub-parts, 33, 43, the foam part is not dimensionally limited by a "trough" in the extrusions. Since the foam subparts 33, 43 are formed independently of the extrusions 31, 35, 41, 45, there is no correlation between waste metal that is removed from a trough to a dimension of the foam sub-part and there is no need to remove or generate waste metal. As a result, the cost of the foam sub-part is only attributable to cost of the foam material and not to the material of the extrusions. Moreover, since the foam subpart is formed independently of the extrusions and subsequently joined mechanically and/or adhesively, the above described restrictions in materials used to form the thermal break associated with the pour-and-de-bridge method and product are not present in the methods and products of the present disclosure, allowing the formation of the foam sub-parts 33, 43 and selection of foam material to be optimized independently of the extrusions 31, 35, 41, 45.

It will be understood that the embodiments described herein are merely exemplary and that a person skilled in the art may make many variations and modifications without departing from the spirit and scope of the claimed subject matter. For example, while the present disclosure refers to composite structural members of moveable windows, the teachings of the present disclosure could be applied to other structures employed in establishing and maintaining a building envelope, such as doors, skylights and fixed window systems. All such variations and modifications are intended to be included within the scope of the appended claims.

We claim:

1. A weather barrier device for covering an opening in a structure, comprising:

at least one glazing panel;

a plurality of support members disposed about the periphery of the glazing panel;

at least one elongated, rigid structural foam member having a rectangular cross-sectional shape with four flat outer surfaces;

a first rigid elongated member and a second rigid elongated member, each of the first rigid elongated member and the second rigid elongated member having a recess therein capable of accommodating the foam member to form a composite member with the first rigid elongated member on one side of the foam member and the second rigid elongated member on another side of the foam member to form the composite member, wherein the recess in each of the first rigid elongated member and the second rigid elongated member has a U-shaped cross section defined by a pair of legs extending at 90 degrees from a back wall, the foam member being slidably received between the pair of legs without deforming the pair of legs and without distorting the rectangular cross-sectional shape of the foam member, the pair of legs being parallel to one another and spaced from one another a distance equal to a width of the foam member, each of the first rigid elongated member and the second rigid elongated member having at least one spacer extending from the back wall thereof to provide a space for adhesive of a selected thickness to reside between the foam member and the first rigid elongated member and the second rigid elongated member, respectively, when the foam member is in position in the recesses thereof, the at least one spacer of the first rigid elongated member abutting against a first flat outer surface of the foam member and the at least one spacer of the second rigid elongated member abutting against a second flat outer surface of the foam member, preventing the foam member from abutting against the back walls of the first rigid elongated member and the second rigid elongated members, respectively, an adhesive applied between the foam member and each of the first rigid elongated member and the second rigid elongated member, the adhesive adhering the first flat outer surface to the back wall of the first rigid elongated member and the adhesive adhering the second flat outer surface to the back wall of the second rigid elongated member, the first flat outer surface and the second flat outer surface being parallel to one another and to the back wall of each of the first rigid elongated member and the second rigid elongated member, a third flat outer surface and a fourth flat outer surface of the foam member being parallel to each other and to the pair of legs of the first rigid elongated member and to the pair of legs of the second rigid elongated member, a first of the pair of legs of the first rigid elongated member and a first of the pair of legs of the second rigid elongated member positioned proximate the third flat outer surface with a spacing there between greater than the sum of a combined length thereof measured in a direction extending between the first rigid elongated member and the second rigid elongated member, a second of the pair of legs of the first rigid elongated member and a second of the pair of legs of the second rigid elongated member positioned proximate the fourth flat outer surface with a spacing there between greater than the sum of a combined length thereof measured in a direction extending between the first rigid elongated member and the second rigid elongated member, forming the composite member, the composite member forming at least one of the plurality of support members.

2. The device of claim 1, wherein each of the pair of legs has a barb on an edge proximate the recess and distal to the back wall, the barb having a lead-in surface facilitating the sliding of the foam member between the pair of legs and the barbs, the barbs retaining the foam member between the pair of legs, inhibiting removal thereof.

3. The device of claim 1, further comprising reliefs within an interior surface of the recess of each of the first rigid elongated member and the second rigid elongated member, the reliefs providing space for excess adhesive to accumulate therein when the foam member is urged into the recess.

4. The device of claim 3, wherein the elongated rigid members each have a pair of sidewalls extending from the back wall distal to the legs and a outer wall attached to the pair of sidewalls distal to the back wall.

5. The device of claim 4, wherein the elongated rigid members are aluminum extrusions.

6. The device of claim 3, wherein the reliefs include a relief proximate each barb allowing adhesive to contact the third flat outer surface and the fourth flat outer surface of the foam member.

7. The device of claim 1, wherein the device is a window or a door.

8. The device of claim 7, wherein the plurality of support members disposed about the periphery of the glazing panel comprise is surrounded by a sash having four sides, each of the four sides of the sash being formed from a composite member.

9. The device of claim 8, wherein the sash is surrounded by a frame having four sides, each of the four sides of the frame being formed from a composite member.

10. The device of claim 9, further comprising a weather seal attached to at least one of the foam members making up the sash or the frame and wherein at least one of the foam members making up the frame or the sash has a surface against which the weather seal may abut.

11. The device of claim 10, wherein each of the pair of legs has a barb on an edge of the leg proximate to the recess and distal to the back wall, the barb having a lead-in surface facilitating the sliding of the foam member between the pair of legs and the barbs, the barbs aiding in retaining the foam member between the pair of legs, inhibiting removal thereof while the adhesive cures and wherein the weather seal is retained on a plate extending over the foam member and the plate is over-ridden by the barb of one leg of each of the first rigid elongated member and the second rigid elongated member.

12. The device of claim 10, wherein the weather seal is retained on the foam member by adhesive.

13. The device of claim 10, wherein the weather seal is a first weather seal and further comprising at least one other weather seal attached to at least one of the sash or the frame.

14. The device of claim 13, wherein the at least one other weather seal includes two other weather seals, an inside weather seal attached to the frame and an outside weather seal attached to the sash, the first weather seal positioned intermediate the inside weather seal and the outside weather seal.

15. The device of claim 10, wherein the weather seal is retained in an aperture in the foam member by a barbed leg extending from the seal which extends into the aperture.

16. A window, comprising:

at least one glazing panel;

a plurality of support members disposed about the periphery of the glazing panel, each of the plurality of support members having an elongated rigid structural foam member having a rectangular cross-sectional shape with four flat outer surfaces interposed between a first rigid elongated member and second rigid elongated member, each of the first rigid elongated member and the second rigid elongated member having a U shaped cross section defined by a pair of legs extending at 90 degrees from a back wall and defining a recess along more than 50% of the length thereof and capable of slidably accommodating the foam member between the pair of legs without deforming the pair of legs and without distorting the rectangular cross-sectional shape of the foam member to form a composite member with the first rigid elongated member on one side of the foam member and the second rigid elongated member on another side of the foam member, the foam member being received between the pair of legs, the pair of legs being parallel to one another and spaced from one another a distance equal to a width of the foam member, each of the pair of legs having a barb on an edge of the leg proximate to the recess and distal to the back wall, the barb having a lead-in surface facilitating the sliding of the foam member between the pair of legs and the barbs, each of the first rigid elongated member and the second rigid elongated member having at least one spacer extending from the back wall in a direction that the legs extend from the back wall to provide a space for adhesive of a selected thickness to reside between the foam member and the first rigid elongated member and the second rigid elongated member, respectively, when the foam member is in position in the recesses thereof, the at least one spacer of the first rigid elongated member abutting against a first flat outer surface of the foam member and the at least one spacer of the second rigid elongated member abutting against a second flat outer surface of the foam member, preventing the foam member from abutting against the back walls of the first rigid elongated member and the second rigid elongated members, respectively, an adhesive applied between the foam member and the first rigid elongated member and the second rigid elongated member, the barbs retaining the foam member between the pair of legs, the adhesive attaching the foam member to the first rigid elongated member and the second rigid elongated member, the adhesive adhering the first flat outer surface to the back wall of a first rigid elongated member and the adhesive adhering the second flat outer surface distal to the first flat outer surface to the back wall of the second rigid elongated member, the first flat outer surface and the second flat outer surface being parallel to one another and to the back wall of each of the first rigid elongated member and the second rigid elongated member, a third flat outer surface and a fourth flat outer surface of the four flat outer surfaces being parallel to each other and to the pair of legs of the first rigid elongated member and to the pair of legs of the second rigid elongated member, the first flat outer surface and the second flat outer surface being parallel to one another and to the back wall of each of the first rigid elongated member and the second rigid elongated member, a third flat outer surface and a fourth flat outer surface of the foam member being parallel to each other and to the pair of legs of the first rigid elongated member and to the pair of legs of the second rigid elongated member, a first of the pair of legs of the first rigid elongated member and a first of the pair of legs of the second rigid elongated member positioned proximate the third flat outer surface with a spacing there between greater than the sum of a combined length thereof measured in a direction extending between the first rigid elongated member and the second rigid elongated member, a second of the pair of legs of the first rigid elongated member and a second of the pair of legs of the second rigid elongated member positioned proximate the fourth flat outer surface with a spacing there between greater than the sum of a combined length thereof measured in a direction extending between the first rigid elongated member and the second rigid elongated member.

17. The window of claim 16, wherein each of the first rigid elongated member and the second rigid elongated member have a pair of sidewalls extending from the back wall distal to the legs and an outer wall attached to the pair of sidewalls distal to the back wall and are aluminum extrusions.

18. The window of claim 17, wherein the plurality of support members comprise a rectangular frame having four sides, each side of the frame being formed of a support member attached at ends thereof to two other of the sides of the frame.

19. A method for making a weather barrier device for covering an opening in a structure, comprising the steps of:

(A) providing at least one glazing panel;

(B) providing at least one elongated, rigid structural foam member having a rectangular cross-sectional shape with four flat outer surfaces;

(C) providing first and second rigid elongated members, each having a recess therein capable of accommodating the foam member to form a composite member with the first rigid elongated member on one side of the foam member and the second rigid elongated member on another side of the foam member, wherein the recess of each rigid elongated member has a U-shaped cross section defined by a pair of legs extending at 90 degrees from a back wall and each of the pair of legs has a barb on an edge of the leg proximate to the recess and distal to the back wall, the pair of leqs being spaced a distance equal to a width of the foam member;

(D) applying an adhesive to a least one of the foam member or the first and second elongated members;

(E) positioning the foam member between and parallel to the first and second elongated members, the legs of the elongated members facing toward the foam member;

(F) pushing the first and second members towards one another in a direction parallel to the direction of extension of the legs thereof and capturing the foam member and the applied adhesive between the opposing elongated elements, the foam member being slidably received between the pair of legs without deforming the pair of legs and without distorting the rectangular cross-sectional shape of the foam member, the barb having a lead-in surface facilitating the sliding of the foam member between the pair of legs and the barbs, each of the barbs of the pair of legs simultaneously contacting and retaining the foam member in the recesses of the first rigid elongated member and the second rigid elongated member without any other holding means while the adhesive cures;

(G) allowing the adhesive to cure, the adhesive, when cured, adhering a first of the flat outer surfaces to the back wall of a first rigid elongated member and the adhesive adhering a second of the four flat surfaces distal to the first flat surface to the back wall of the second rigid elongated member, forming a composite member;

(H) repeating the above steps to form a plurality of composite members;

(I) attaching the plurality of composite members at the ends thereof to form a frame supporting the glazing panel.

20. The method of claim 19, wherein the step of pushing of the first and second elongated members is conducted simultaneously by a clamp.

* * * * *